United States Patent [19]

Akesson

[11] 4,373,174

[45] Feb. 8, 1983

[54] METHOD FOR PROTECTIVE MAGNETIZATION OF VESSELS

[76] Inventor: Nils B. Akesson, Nytorpsgatan 7, S-216 11 Malmö, Sweden

[21] Appl. No.: 227,881

[22] PCT Filed: Mar. 28, 1979

[86] PCT No.: PCT/SE79/00069

§ 371 Date: Nov. 25, 1980

§ 102(e) Date: Nov. 25, 1980

[87] PCT Pub. No.: WO80/02017

PCT Pub. Date: Oct. 2, 1980

[51] Int. Cl.[3] ..... B63G 9/06

[52] U.S. Cl. ..... 361/149; 114/240 R; 361/143

[58] Field of Search ..... 361/149, 143, 146, 267; 114/240 R

[56] References Cited

U.S. PATENT DOCUMENTS

| | | | |
|---|---|---|---|
| 2,267,838 | 12/1941 | Polin | 361/149 |
| 2,421,583 | 6/1947 | Stuart, Jr. | 361/149 |
| 2,519,395 | 8/1950 | Perlow et al. | 361/149 |
| 2,715,198 | 8/1955 | Tolles | 361/146 |
| 2,793,602 | 5/1957 | Haglolnd | 361/149 |
| 2,832,041 | 4/1958 | Trachtenberg | 361/149 |
| 3,110,282 | 11/1963 | Foerster | 361/149 |
| 3,215,904 | 7/1978 | Burt . | |
| 3,482,163 | 12/1969 | Peek et al. | 361/149 |
| 3,801,877 | 4/1974 | Griese et al. . | |

FOREIGN PATENT DOCUMENTS

| | | | |
|---|---|---|---|
| 1038432 | 9/1958 | Fed. Rep. of Germany . | |
| 1101207 | 3/1961 | Fed. Rep. of Germany . | |
| 1516964 | 7/1969 | Fed. Rep. of Germany . | |
| 977881 | 1/1972 | Fed. Rep. of Germany . | |
| 2659552 | 6/1978 | Fed. Rep. of Germany | 361/143 |

*Primary Examiner*—A. D. Pellinen
*Assistant Examiner*—L. C. Schroeder
*Attorney, Agent, or Firm*—Berman, Aisenberg & Platt

[57] ABSTRACT

A method for the protective magnetization of vessels by using magnetic loops (11).

The field strength of the magnetic field surrounding the vessel is detected by means of a Hall generator (12) and the current through the magnetic loop (11) is controlled in dependence on the field strength thus detected.

6 Claims, 2 Drawing Figures

METHOD FOR PROTECTIVE MAGNETIZATION OF VESSELS

In vessels of steel or vessels of wood with a large iron mass, for example in the engine and the engine bed, a permanent magnetization (magnetic remanance) is often obtained because of the terrestrial magnetism. Such a magnetization can trigger magnetic mines, and for this reason protective magnetization of the vessel is provided. For the protective magnetization of the vessel while in motion, so that the magnetization which is more or less powerful depending on the position of the vessel in the earth's magnetic field, is constantly suppressed by applying a counteracting magnetic field, adapted to the strength of the magnetization caused by the earth's magnetic field, magnetic loops are used in the vessel, placed athwartships as well as fore-and-aft. The loops can then receive current in dependence on the heading of the vessel in accordance with a programmed predetermined relation between heading and current strength. A signal which is representative of the heading is supplied by the compass of the vessel (magnetic compass or gyrocompass). It is also known to control the current through the magnetic loops by means of magnetic probes in dependence on variations in the magnetic component of the earth's field on pitching and rolling movements of the vessel and on changes of course.

The protective magnetization which is achieved in this manner is not satisfactory, partly because the magnetization takes place with a certain inertia in relation to the angular movement of the vessel and partly above all because alterations in the iron mass of the vessel, which act on the field strength of the magnetic field, are not taken into consideration.

The purpose of the invention is to provide a control of the protective magnetization, which is more adaptable to the prevailing conditions, and for this purpose the invention provides a method for protective magnetization of vessels by using a magnetic loop which is energized in dependence on the heading of the vessel and on the longitudinal and transverse inclination thereof, with the characteristics which can be seen from claim 1.

By this means, the effect is achieved that the protective magnetization always follows the magnetic remanance actually existing at the present moment. Because the Hall generator has a limited range, it does not detect the field strength of the earth's magnetic field but the field strength of the magnetic field surrounding the vessel, which provides an important advantage because as a result the Hall generator will control the energization of the magnetic loop also in dependence on those alterations in the field strength of the magnetic field surrounding the vessel, which are caused by alterations in the iron mass of the vessel, for example as a result of the loading and unloading of a cargo containing iron.

Figure 1:
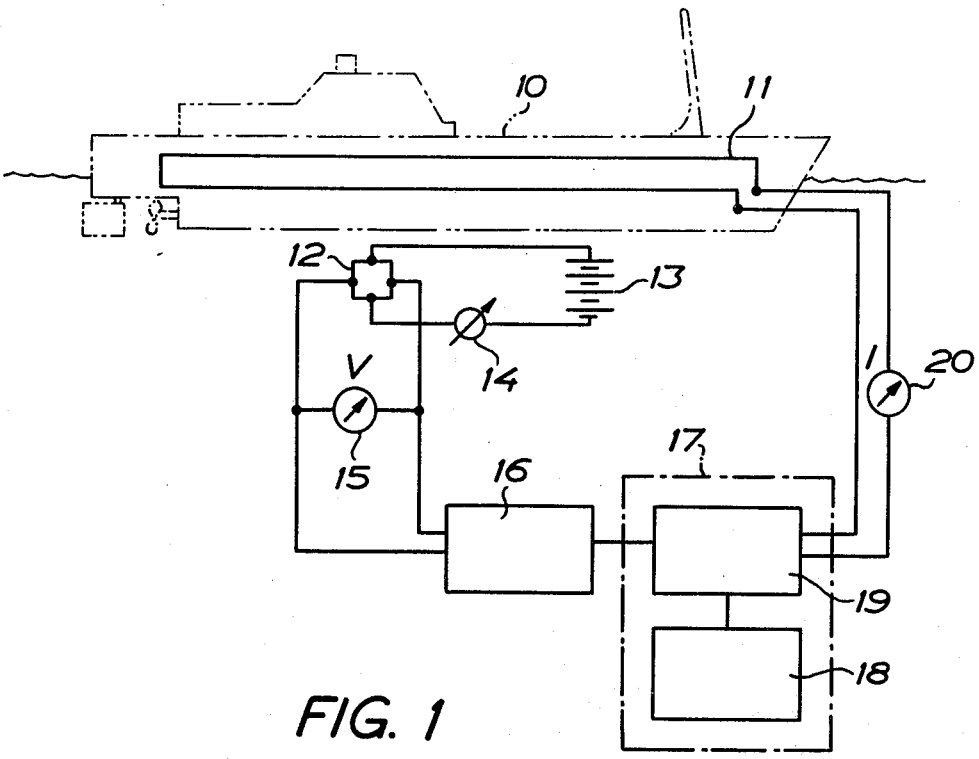
Figure 2:
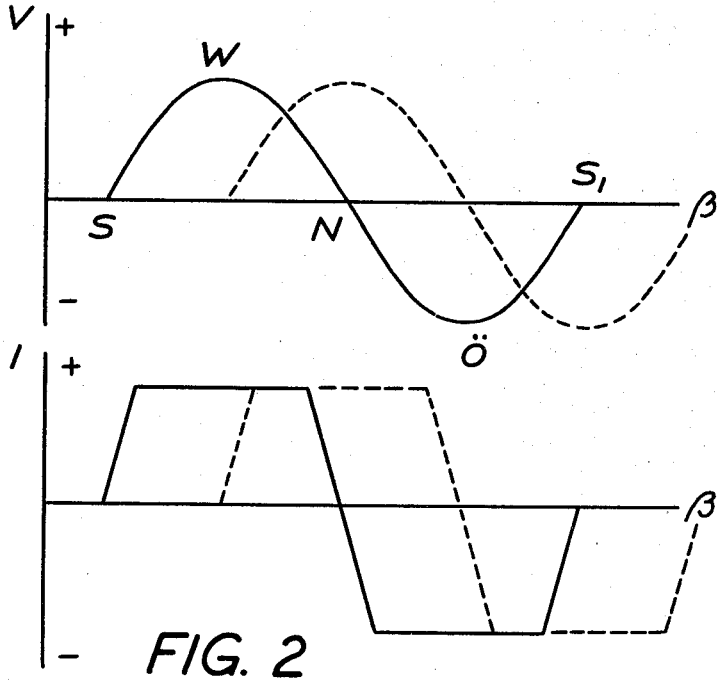

In order to illustrate the invention, examples of carrying out the method are described in more detail below with reference to the accompanying drawing in which FIG. 1 is a diagram of an installation for carrying out the method, and FIG. 2 is a diagram illustrating the relation between a control signal which depends on the field strength of the magnetic field surrounding the vessel, and the current generated for the protective magnetization.

FIG. 1 shows diagrammatically a vessel 10 in which there is provided a magnetic loop 11 which is laid fore-and-aft and which can be of conventional construction. Only one loop is shown here but a plurality of fore-and-aft loops coupled in parallel can be provided, and they may lie in the longitudinal central plane of the vessel or at each side of the central plane. Under the vessel, at the lower side of the bottom thereof or in a tube or the like, passed through the bottom of the vessel, there is disposed a Hall generator 12. In order to control a magnetic loop 11 disposed fore-and-aft, this Hall generator should have the plane of its plate in the fore-and-aft direction of the vessel, as indicated in the drawing in FIG. 1, and the Hall generator should be mounted in the central fore-and-aft plane of the vessel and in such a position in the longitudinal direction of the vessel that it is located where the magnetic field surrounding the vessel has its maximum field strength, that is to say where the iron mass of the vessel is greatest. In FIG. 1 it is assumed that this position in the vessel lies substantially at the superstructure where the ship's engine is situated. Thus the magnetic flux caused by the earth's magnetic field is directed at right angles to the plane of the drawing and at right angles to the plate of the Hall generator 12.

One pair of opposite edges of the plate of the Hall generator 12 are connected to a DC source 13 via suitable control means 14, for example a variable resistor, and when a current from the current source 13 is supplied to the Hall generator, the other pair of opposite edges of the plate of the Hall generator 12 will receive a voltage which can be designated by V and the magnitude of which depends on the magnitude of the magnetic flux which reaches the plate of the Hall generator. This voltage can be supplied to a voltmeter 15 to indicate the voltage and is supplied to an amplifier 16 with one or more amplifier stages. The amplifier 16 controls a power unit which is generally designated by 17 and includes on the one hand a DC source 18 and on the other hand a current regulator 19, for example a current regulator of the thyristor type. The power unit delivers direct current to the magnetic loop 11 via an ammeter 20, and the magnitude and direction of the current, which may be designated I, is controlled in dependence on the magnitude and direction of the signal voltage obtained from the Hall generator 12, that is to say in dependence on the magnitude of the field strength of the magnetic field surrounding the vessel at right angles to the plate of the Hall generator.

In FIG. 2, the upper sinusoidal curve shows the variation in the signal voltage V which is obtained from the Hall generator 12 and which is measured at the voltmeter 15, when the vessel turns through 180°, the ordinate indicating the voltage V and the abscissa indicating the yaw angle $\beta$. If, as assumed in FIG. 1, it is a question of a Hall generator 12 with the plate in the fore-and-aft direction of the vessel, said voltage from the Hall generator will be substantially at zero when the vessel is in the North-South direction, and will be at maximum when the vessel is in the East-West direction. The upper curve in FIG. 2 shows a zero point S and in this position it is assumed that the vessel has its stem to the South. On turning in clockwise direction, the signal voltage will increase in the positive direction following the sinusoidal curve to a maximum value in the point W, corresponding to a position of the vessel with the stem to the West, and on continued turning of the vessel, the voltage will decrease in accordance with the sinusoidal curve to a zero value when the vessel has its stem to the North, N. The signal voltage describes a corresponding half sinusoidal curve in the negative direction when the stem of the vessel is turned towards the East, point O, and then again towards the South, point $S_1$.

The lower curve in FIG. 2 shows the current I which is supplied by the power unit 17 to the magnetic loop 11 in dependence on the signal voltage V. This current, indicated on the ordinate in the lower part of the diagram in FIG. 2, is measured on the ammeter 20. The abscissa in the lower part of FIG. 2 indicates the yaw angle $\beta$ like the abscissa in the upper part. It is seen that the sinusoidal increase in the voltage V from the point S to the point W initially gives rise to a rather steep rise of the current I in the positive direction along a portion of the curve in the lower part of FIG. 2 going obliquely upwards, so that the current I reaches a positive maximum value already during the initial first quarter of the increase in the voltage V. The current is then maintained constant at this value to fall along a correspondingly steep curve to the value zero during the latter quarter of the descending portion of the voltage curve, just before the point N. In the negative part of the sinusoidal voltage curve, the current I follows a corresponding negative current curve, as can be seen from FIG. 2. The shape of the current curve is obtained by suitable selection of the characteristic of the amplifier 16. Because the current does not immediately go up to a maximum value after the passage of the zero points of the voltage, hunting is avoided in the system.

As can be seen, a remanent magnetic field of a certain strength, surrounding the vessel will generate a signal voltage V from the Hall generator 12, which in turn gives rise to an energizing current I for the magnetic loop 11 from the power unit 17 with such a direction of current that the magnetic field detected is eliminated or suppressed. Thus a constant interaction is obtained between the magnetic field acting on the Hall generator 12, and the magnetization current in the magnetic loop 11, so that the magnetic field round the vessel is maintained at a field strength which is substantially equal to zero, regardless of the course on which the vessel is set and regardless of the position of the vessel in the water. There is also compensation for alterations in the field strength of the magnetic field as a result of alterations in the iron mass of the vessel, since the protective magnetization takes place in dependence on the state of magnetization prevailing at the present moment. A low current always passes through the magnetic loop 11, however, since the protective magnetization of the vessel which is obtained by energization of magnetic loop thereof does not remain permanently in existence; if the magnetization current 11 had been interrupted completely, the vessel would soon be magnetized again.

A corresponding protective magnetization can be obtained with magnetic loops which lie in the athwartships direction of the vessel, in which case the plate of the Hall generator 12 should also lie in the athwartships direction of the vessel. The signal voltage V is then phase-shifted by 90° so that it has its zero points in the West-East and its maximum points in the North-South, as indicated by a broken curve in FIG. 2, where the corresponding current curve is also shown by a broken line.

A plurality of Hall generators can be arranged in the fore-and-aft direction and in the athwartships direction and a protective magnetization system with one or more loops can be provided for each Hall generator. In this manner, the detection of the field strength of the magnetic field round the vessel can be made at the points where the field strength is greatest and is exposed to the greatest variations, for example as a result of the fact that the iron mass of the vessel is increased or reduced because of loading or unloading cargo containing iron. The firing of torpedoes or projectiles from a naval vessel can be compared with the unloading of cargo containing iron.

I claim:

1. A method for the protective magnetization of a vessel having a magnetic loop comprising:

detecting the actual field strength of the magnetic field surrounding the vessel, as a function of the heading and longitudinal and transverse inclinations of the vessel, with a Hall generator, and controlling the current through said magnetic loop so that the absolute value of the magnitude of the current increases faster than does the output of the Hall generator, to a maximum value.

2. A method according to claim 1, characterized in that the field strength is detected near the bottom of the vessel.

3. A method according to claim 1, characterized in that a direct current is supplied to the Hall generator (12) and that the output signal (V) thereof depending on the magnetic field at right angles to the plane of the generator plate, after amplification, is used to control a power unit (17) to feed the magnetic loop (11) with direct current.

4. A method according to any one of claims 1, 2 or 3, characterized in that the field strength of the magnetic field is detected in the athwartships direction of the vessel and is supplied to one or more magnetic loops disposed athwartships.

5. A method according to any one of claims 1, 2 or 3, characterized in that the field strength of the magnetic field is detected in the fore-and-aft direction of the vessel and is supplied to one or more magnetic loops disposed fore-and-aft.

6. A method according to claim 1, characterized in that the detection of the field strength of the magnetic field is effected at one or more positions and that each signal is supplied to a separate protective magnetization system with one or more magnetic loops.

* * * * *